United States Patent [19]

Cepuritis

[11] 4,031,594

[45] June 28, 1977

[54] SEALLESS STRAP CONNECTION MEANS

[75] Inventor: Talivaldis Cepuritis, Kenilworth, Ill.

[73] Assignee: Signode Corporation, Glenview, Ill.

[22] Filed: Apr. 26, 1976

[21] Appl. No.: 680,164

[52] U.S. Cl. ..... 24/20 EE; 24/23 EE; 403/375; 403/393

[51] Int. Cl.[2] ..... B65D 63/02

[58] Field of Search ..... 24/20 R, 20 EE, 23 EE; 403/375, 393

[56] References Cited

UNITED STATES PATENTS

| | | | |
|---|---|---|---|
| 2,059,906 | 11/1936 | Prestwich | 24/20 EE |
| 3,426,392 | 2/1969 | Timmerbeil | 24/20 EE |
| 3,921,365 | 11/1975 | Nute, Jr. et al. | 403/393 |
| 3,934,918 | 1/1976 | Kress et al. | 24/20 EE X |
| 3,935,616 | 2/1976 | Simmons | 24/20 EE |

*Primary Examiner*—Werner H. Schroeder
*Assistant Examiner*—Conrad L. Berman
*Attorney, Agent, or Firm*—Dressler, Goldsmith, Clement, Gordon & Shore, Ltd.

[57] ABSTRACT

Overlapping ends of metal strap, or the like, are aligned and connected without the aid of an overlying supplemental seal or fastener by means of an array of longitudinally spaced joints which form a one-way interlocking relationship. The joints comprise juxtaposed protuberances formed by slits in the strap ends, integral with the overlapping strap segments, which override each other as the interlocking relationship is formed. A protuberance in the array on one of the strap ends is formed to additionally function as an integral anti-disengagement stop. This protuberance has an upturned corner forming a protruding tongue which, upon shifting of the joined overlapping lengths of metal strap relative to each other in a direction tending to disengage the joints, abuts a portion of the protuberance in a corresponding slit of the other strap to provide a stop preventing disengagement.

8 Claims, 7 Drawing Figures

SEALLESS STRAP CONNECTION MEANS

BACKGROUND OF THE INVENTION

This invention relates to sealless joints or splices in strap made of relatively stiff sheet material, i.e., metal strap and the like.

It is known to provide sealless connections between strap ends in the form of an array of longitudinally spaced joints. A very common form of such a joint utilizes a central tongue provided with lateral wing extensions partly along the opposite edges of the tongue. However, the load handling strength of such a connection is reduced because the width of the wing extensions reduces the effective cross section of the strap.

Variations of the aforementioned double wing tongue joint have been suggested over the years. Representative prior art patents in this particular field of art are U.S. Pat. No. 180,910 to Olmsted, U.S. Pat. No. 1,606,331 to Anderson, U.S. Pat. Nos. 2,268,339 and 2,276,988 to Leslie, U.S. Pat. No. 3,137,047 to Mosey, U.S. Pat. No. 3,177,538 to Timmerbeil, and U.S. Pat. No. 3,188,706 to Partridge. Yet in all of the foregoing variations, the effective cross-sectional area of the strap is considerably reduced at the connection, thereby reducing the tensile strength of the connected strap. A sealless connection wherein a relatively higher strength at the connection is realized and lateral pull out action is avoided or minimized is taught in U.S. Pat. No. 3,303,541 to Beach.

In all but one of the aforesaid instances the connection is maintained only while the joined overlapping ends are kept under tension. When tension is temporarily released on the connection, or when the overlapping strap ends are longitudinally shifted relative to each other as someone bumps against the strap connections formed around a temporarily compressed bundle of material which is in the process of being strapped, i.e., a bale of cotton, or the like, the connections will release and the joined strap ends will again separate.

In the aforementioned U.S. Pat. No. 3,188,706 to Partridge, there is disclosed a means to lock a produced one-way tension connection by embosssing internested dimples in the overlapped connected strap segments. However, a special tool is required for this purpose, thus the proposed locking means is cumbersome to use. Where a large number of workers performs strapping operations at about the same time, a sizeable investment in special tools must be made. Moreover, unless the embossing is done with care, camming surfaces are formed around the periphery of the embossments which camming surfaces tend to spread the internested dimples apart when the strap segments are subjected to a lengthwise force, i.e., by dropping or subsequent compression of a tied bundle. This action by the camming surfaces will tend to defeat the desired locking action when the lengthwise force is a compressive force, and may promote tearing of the interlocking joints in instances where the connected strap is overtensioned. The fastenerless splice of U.S. Pat. No. 3,188,706 also is cumbersome to form because a two-step operation is needed, i.e., the joints must first be made to interlock and then the internested dimples have to be formed.

An approach to overcoming the foregoing difficulties is disclosed in U.S. Pat. No. 3,935,616 to Simmons, wherein selected juxtaposed protuberances override each other to present face-to-face abutments when the strip ends are shifted relative to each other in interlock disengaging direction.

The present invention, on the other hand, contemplates a sealless strap connection having an integral locking and antidisengagement means which is provided on a single protuberance, which obviates the aforementioned drawbacks, and which does not require any tools for affixation.

SUMMARY OF THE INVENTION

The present invention contemplates an array of longitudinally spaced joints, formed by overlapping strap segments and connecting a pair of strap ends against pull-out, in combination wih an anti-disengagement means on at least one of such joints, retaining the longitudinally spaced joints in an interlocking position once the joints are formed and regardless of whether the formed joints are under tension.

Each joint comprises lengthwise protuberances presenting opposed overlapping shoulders which are displaced from respective planes of the overlapped strap lengths or segments. The lengthwise opposed shoulders are defined by a pair of juxtaposed, staggered slits in the overlapping strap segments and are shaped so as to interlock with each other. A trailing corner on one of the protuberances in the slit array at one of the strap ends has a protruding tongue formed by an upturned corner of the protuberance which irreversibly engages the corresponding slit in the other strap end and provides a stop thereagainst when the opposedshoulders are moved in a direction tending to disengage a formed joint. This action retains the other joint-forming opposed shoulders interlocked with each other as well.

In a preferred embodiment, for each joint each transverse section of each of the overlapping strap segments forming the sealless connection is provided with a single staggered slit defined and flanked by complementary integral strap web portions that are offset in opposite directions normal to the plane of the strap segments. The strap web portions form opposed shoulders so that juxtaposed strap web portions on one strap segment provide lengthwise aligned shoulders matched to corresponding shoulders on the other strap segment. In overlapping strap segments, the inner opposed shoulders of each strap web portion interlock along the staggered slits when the overlapping strap segments are shifted longitudinally.

The strap web portion behind one of the shoulders in the sequence or array thereof on one of the strap ends, however, has an additional slit and an upturned corner to form a protruding tongue, so that when the overlapping strap segments are shifted longitudinally in a direction tending to disengage the interlocked shoulders, the tongue will engage as a stop against a shoulder of the other strap. Joint-forming arrangements embodying the present invention also provide for faster, surer and easier joining in that the abutment of the tongue enables the completed joint to be "tested" for proper interlocking by pushing the straps together in the disengaging direction—the properly made joint will not disengage. Preferably, the strap web portion provided with the upturned corner is situated at one end of the sequence or array.

Numerous other advantages and features of the invention will become readily apparent from the following detailed description of the invention, from the claims and from the accompanying drawings in which each and every detail shown is fully and completely disclosed as a part of this specification.

BRIEF DESCRIPTION OF THE DRAWING

In the accompanying drawing which illustrates embodiments of the present invention.

DESCRIPTION OF THE PREFERRED EMBODIMENTS

Figures 1, 2, 3, 4, 5, 6, 7:
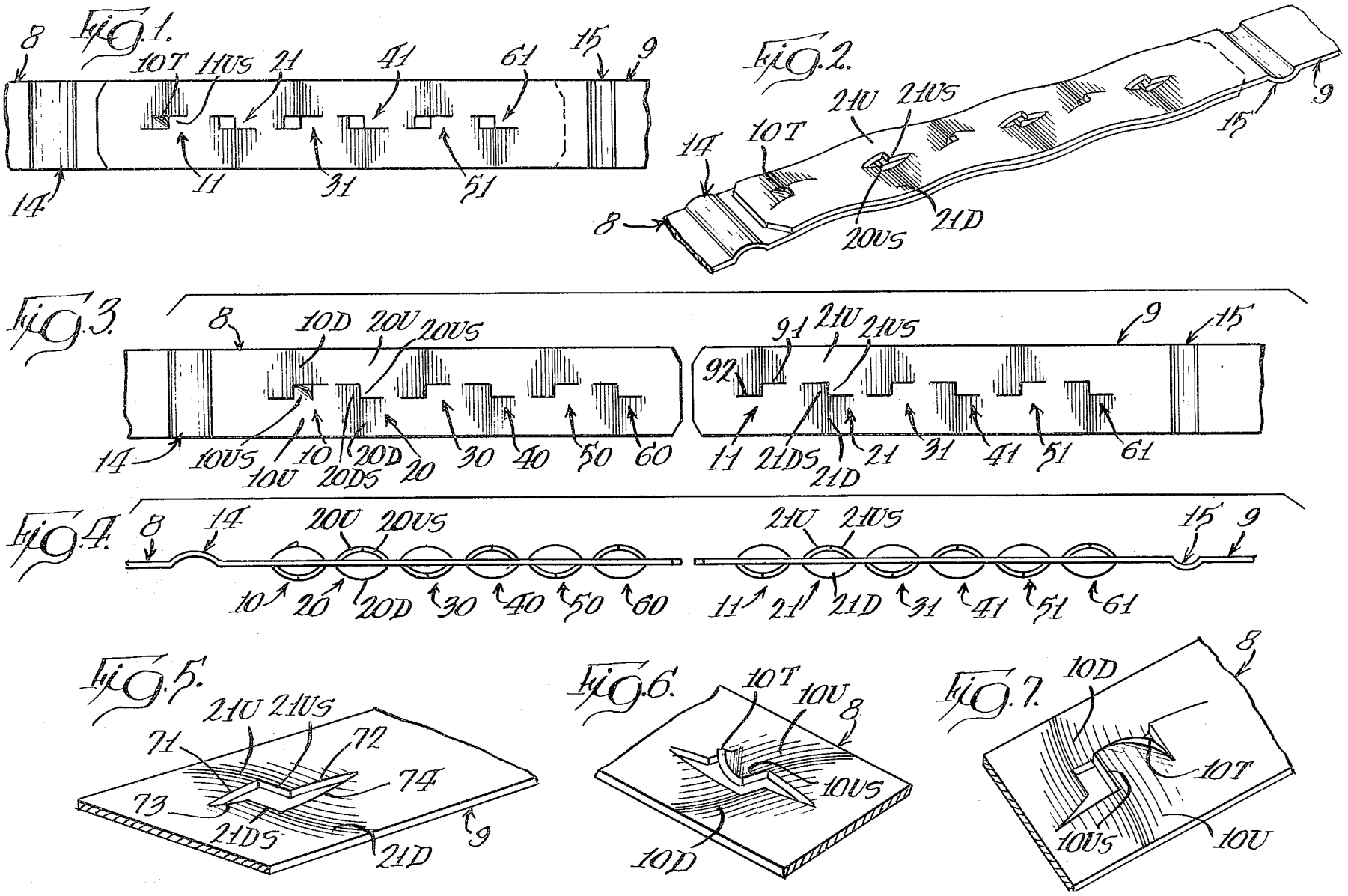
FIG. 1 is a fragmentary plan view of overlapping lengths of strap nested in full registry and longitudinally offset into an interlocking relationship.
FIG. 2 is a fragmentary perspective view of portions of the strap lengths pictured in FIG. 1 and showing the same interlocked.
FIG. 3 is an enlarged fragmentary plan view of the fabricated strap ends of FIG. 1.
FIG. 4 is a side elevational view of the strap ends pictured in FIG. 3.
FIG. 5 is a fragmentary perspective view of the joint element protuberance comprising slit-formed shoulders defined by slit number 21 in FIG. 3.
FIG. 6 is an enlarged fragmentary perspective view of the protuberance provided with an anti-disengagement means showing the upturned corner forming a protruding tongue.
FIG. 7 is another fragmentary perspective view of the anti-disengagement tongue of FIG. 6 when rotated about ninety degrees.

While this invention is susceptible of embodiment in many different forms, there is shown in the drawings and will herein be described in detail one specific embodiment, with the understanding that the present disclosure is to be considered as an exemplification of the principles of the invention and is not limited to the embodiment illustrated. The scope of the invention will be pointed out in the appended claims.

Referring now to the FIGURES, shown are lower and upper overlaped lengths, segments, or ends of metal strap 8 and 9, respectively, for tension-transmitting interengagement by means of a sealless strap connection defined therebetween. Sealless strap connections usually include a tandem array of longitudinally spaced shear lock joints, six of which are shown in FIG. 1 and FIG. 2 with a single joint on the left and being formed differently to provide an integral anti-disengagement means. More or less joints can be used, as desired. The particular sections of strap which overlap and interlock to make up each joint are configured to nest substantially fully in one another to enable the overlapping strap lengths 8 and 9 to engage in substantially full surfaced contact. In a sixth-joint connection array, each strap length has six such nestable sections. The integral anti-disengagement means is positioned at the left and and formed by coacting slits in the overlapping straps 8 and 9.

A full strap can be manufactured from a continuous strip with spaced, pre-notched severance points between the sets of preformed shear lock joint arrays. When a strap is to be secured around a package, bulk material, or the like, the strap is cut at the notches and strap ends 8 and 9 are placed around the package. The package is temporarily under compression while the strap ends are placed in the overlapping locking configuration shown in FIG. 1 and FIG. 2. If desired, transverse indentations 14 and 15 can be provided in strap segments 8 and 9, respectively, to assist in properly locating these segments when the sealless connection is about to be formed.

As shown in FIG. 3 and FIG. 4, indentation 14 is convex and indentation 15 is concave (when viewed from the top as in FIG. 3); however, any other arrangement of these indentations may be utilized as a locating aid.

Each of the nestable strap sections of the upper strap 9, as shown in FIGS. 3 and 4, is characterized by lengthwise directed staggered slits 11, 21, 31, 41, 51, and 61 defined and flanked by corresponding complementary pairs of strap web portions, such as 21U–21D on either side of slit 21, that integrally merge endwise with full body regions of the strap and that are offset in opposite normal directions from the plane of the strap. On one side of each slit, the web portion is offet upwardly to form a protuberance and on the other side, the web is offset downwardly to form a protuberance. Each offset web portion presents a shoulder with a transverse face. For example, the shoulder of web portion 21U is shown in FIGS. 2, 3 and 4 and is designated 21US.

FIG. 5 shows in more detail the configuration of a staggered slit and, in particular, the slit 21 of FIGS. 2 and 3. In FIG. 5, shoulder 21US is shown in the upwardly offset web portion 21U above the plane of the strap 9. The face of shoulder 21US is in the "jog region" of the slit and runs perpendicular to the side edge of the strap end 9. Lengthwise regions 71 and 72, parallel to the side edges of the strap end 9, define the ends of the face of shoulder 21US and separate the upwardly offset web portion 21U from the downwardly offset web portion 21D. Lengthwise regions 73 and 74 are substantially parallel to the side edges of strap web 9 and define the edges of downwardly offset web portion 21D. In the lateral jog region between the lengthwise regions 73 and 74 is shoulder 21DS. The face of shoulder 21DS is substantially perpendicular to the side edges of strap 9 and is aligned substantially parallel to the face of upper shoulder 21US.

The configuration of joint slits 41 and 61 is substantially identical to joint slit 21 described above. The balance of the slits of the upper strap 9, slits 11, 31 and 51 are reversed, compared to slits 21, 41 and 61, as can be seen in FIG. 3. These slits have substantially the same configuration as shown in FIG. 5, except as necessarily modified (reversed) with respect to orientation.

Like upper strap 9 described above, each of the nestable strap sections of the lower strap 8, with the notable exception of the section containing special slit 10 in FIG. 3, is characterized by a substantially identical lengthwise directed slit defining and flanked by complementing strap web portions presenting shoulders that are normal to the plane of the strap.

In particular, for example, the nestable strap section of lower strap 8 containing slit 20 corresponds to the nestable section containing slit 21 of upper strap 9 as shown in FIG. 3. Slit 20 is defined and flanked by a complementary pair of strap web portions 20U and 20D that integrally merge endwise with the full body regions of the strap 8 and that are offset in opposite normal directions from the plane of the strap. Web portion 20U is offset upwardly and web portion 20D is offset downwardly, thereby presenting shoulders 20US and 20DS, respectively.

The configurations of slits 40 and 60 of lower strap 8 are substantially identical to slit 20 described above. The nestable strap sections of the lower strap 8 containing slits 30 and 50 are characterized by a substantially identical, but reversed, lengthwise directed slit defining and flanked by complementary strap web portions presenting shoulders that are normal to the plane of the strap. The remaining slit 10 additionally functions to prevent disengagement and will be described later.

A joint of slits 20, 30, 40, 50, and 60, coacting, respectively, with slits 21, 31, 41, 51, and 61, will now be described. For this purpose, the interlocking of just one pair of slits of the array will be described since the interlockingof the other slit pairs is analogous. Considering slit 20 of strap segment 8 and corresponding slit 21 of strap segment 9, when strap lengths 8 and 9 are superimposed in full registry, as shown in FIG. 1, the corresponding staggered slits of the array, including, in particular, slits 20 and 21, are in juxtaposition and in contact with each other. In this position, and considering the completed joint shown in FIG. 2, the undersurface of shoulder 21US of upper strap 9 rests on the upper surface of the shoulder 20US of lower strap 8. Similarly, the lower surface of the shoulder 21DS of upper strap 9 rests on the upper surface of shoulder 20DS (hidden in FIG. 2) of lower strap 8.

Thereafter, the strap lengths are shifted longitudinally, as shown in FIG. 2,—strap 8 to the left and strap 9 to the right—to effect a one-way mutual interlocking relationship between the shoulders 21DS and 20US as shoulder 20US slides over shoulder 21DS. Shoulder 20US of strap 8 wedges between the opposed slanting surfaces of web portions 21U and 21D of strap 9 (FIGS. 2 and 3). Shoulder 21DS of strap 9 wedges between the opposed slanting surfaces of web portions 20U and 20D of strap 8. The wedging action prevents further movement of strap 8 to the left and strap 9 to the right, thereby locking the strap ends together.

Thus, it is seen in the completed joint that shoulders 20US and 21DS are the pair of inerlocking shoulders and shoulders 20DS and 21US are the non-interlocking shoulders. In each pair of interlocked slits of a joint, the two inner shoulders (one from each strap end) are the interlocking shoulders and the two outer shoulders (one from each strap) are the non-interlocking shoulders.

In addition to forming part of the interlocking joint, the special slit 10 of the array of lower strap 8 functions to prevent disengagement of the interlocked straps. In FIG. 3, slit 10 on the end of the array is formed differently from the remaining slits on lower strap 8 and upper strap 9. Contiguous with slit 10 and in a portion of the strap web protuberance behind a shoulder is an anti-disengagement protuberance defined by an additional slit and an upturned corner which forms a protruding tongue. The shape of this portion of the strap web protuberance with the additional protruding tongue 10T is shown in FIGS. 6 and 7 which are enlarged fragmentary perspective views of slit 10 of FIG. 3.

In FIGS. 6 and 7, an upwardly offset web portion 10U protrudes above the plane of lower strap 8 forming shoulder 10US which has a transverse face running substantially perpendicular to the edge of strap end 8. The protruding tongue 10T projects upwardly from the upper surface shoulder 10US.

When the straps 8 and 9 are superimposed in full registry and before they are pulled together longitudinally to interlock as shown in FIGS. 1 and 2, the nestable strap section containing slit 11 in upper strap 9 rests on top of the nestable strap section containing slit 10 in lower strap 8. Projecting above the plane of upper strap 8 at slit 11 is shoulder 11US (FIG. 1) which lies directly over shoulder 10US of lower strap 8. As the two straps are pulled together, the protruding tongue 10T behind shoulder 10US of lower strap 8 slides (to the left in FIG. 1) under upper strap 9 and then slides completely past the edge of shoulder 11US in upper strap 9, whereby tongue 10T, temporarily displaced downwardly by shoulder 11US, springs upwardly to protrude through slit 11 beyond the top surface of shoulder 11US.

If the straps 8 and 9 are accidentally pushed together in the reverse direction longitudinally, disengagement of the interlocking slots of the joint array is prevented by the protruding tongue 10T which then becomes butted in slit 11 against the face of shoulder 11US in upper strap 9. This reverse butting engagement prevents the straps from being pushed further together and thus prevents the joint from disengaging.

Joint-forming arrangements embodying the present invention provide for faster, surer, and easier joining. To make a connection of the two straps and form a completed joint, the upper strap end 9 is placed on top of the lower strap end 8. Slits 10, 20, 30, 40, 50, and 60 are partially engaged with the corresponding slits 11, 21, 31, 41, 51, and 60 and the straps are moved longitudinally relative to each other to fully interlock all of the joint-forming shoulders.

The slit orientation is not overly critical. The staggered slits can be centered and aligned, or can be arrayed in a non-centered balanced pattern, as desired. A staggered slit is here said to be centered when the midpoint of the shoulder (lateral jog region) is approximately on the strap centerline. For this condition, the flanking strap web portions are equal in effective cross section and the forces transmitted by the strap balance out about the fulcrum point established by the interlocking shoulder, thus avoiding strap twisting effect. With the exception of the disengagement slit, the joint slits can all jog in the same lateral direction, or some of them can jog in an opposite lateral direction, if desired.

It should be noted that each of the slits may be provided with a straight companion slit to provide a laterally facing abutment for preventing lateral pull-out movement; however, with the centered, right-angled slit configuration, these companion slits are not required. Such companion slits can be used where the staggered slits are off the strap centerline.

The foregoing description and the drawings are intended as illustrative and are not to be taken as limiting. Still other variations and/or rearrangements of parts within the spirit and scope of the present invention are possible and will readily present themselves to the skilled artisan.

What is claimed is:

1. A sealless strap connection between overlapped lengths of strap which comprises an array of longitudinally spaced joints, each joint comprising lengthwise protuberances presenting opposed, overlapping, non-interlocking shoulders each having a transverse face displaced for the respective planes of said overlapped lengths of strap and further comprising lengthwise protuberances presenting opposed interlocking shoulders each having a transverse face displaced from the respective planes of said overlapped lengths of strap, said interlocking shoulders being shaped to interlock with each other, at least one of the protuberances of said array on one of said lengths of strap having, behind the transverse face of one of said interlocking shoulders, an upwardly displaced corner forming a protruding tongue arranged and positioned to irreversibly override the transverse face of an oppositely facing non-interlocking shoulder as the interlocking shoulders are moved into an interlocking position, and to present a stop to the non-interlocking shoulder adjacent to said corner when said interlocking shoulders are interlocked with each other.

2. The sealless strap connection in accordance with claim 1, wherein said upwardly displaced corner is formed in a protuberance of a joint element which is located at one end of said array.

3. The sealless strap connection in accordance with claim 1, wherein said protuberances are defined by juxtaposed, staggered slits in said overlapping lengths of strap.

4. The sealless strap connection in accordance with claim 3, wherein each protuberance is defined by a substantially Z-shaped slit having a substantially transverse central region and said protruding tongue presents an abutment to the transverse face of said oppositely facing non-interlocking shoulder in said transverse region of the slit thereof.

5. A sealless strap connection between overlapped lengths of strap which comprises an array of longitudinally spaced joints, each joint comprising lengthwise protuberances presenting opposed non-interlocking shoulders each having a transverse face displaced from the respective planes of said overlapped lengths of strap, each joint further comprising lengthwise protuberances presenting opposed interlocking overlapping shoulders each having a transverse face displaced from the respective planes of said overlapped lengths of strap; paired non-interlocking and interlocking shoulders in each of said lengths of strap defining openings therein; said interlocking shoulders being shaped to interfit into said openings and interlock with each other; at lease one of the protuberances of said array on one of said lengths of strap having, behind the transverse face of one of said interlocking shoulders, an upwardly displaced corner forming a protruding tongue arranged and positioned to irreversibly override the transverse face of an oppositely facing non-interlocking shoulder as the interlocking shoulders are moved into an interlocking position and to present a stop to the non-interlocking shoulder adjacent to said corner when said interlocking shoulders are interlocked with each other.

6. In a sealless strap connection between overlapped lengths of metal strap, an array of longitudinally spaced shear lock joints, each joint being defined between nestable strap sections provided by matched integral portions of each length of metal strap, said nestable strap sections that define each joint being partly offset longitudinally to engage in one-way mutually interlocking relationship, each said nestable strap section having a single longitudinally oriented staggered slit comprised of lengthwise slit end regions and a lateral jog region joining the slit end regions, each staggered slit defining and being flanked by complementary integral strap web portions offset in opposite normal directions to present a lengthwise interlocking shoulder opposed by a lengthwise non-interlocking shoulder, each of said shoulders having a transverse face bordering the intermediate jog region of the slit, each joint having each of its nestable strap sections presenting said interlocking shoulder nestable within the jog region of the other strap section and enterable endwise into the opposing slit end region of said other section to establish one-way interlocking engagement therebetween, and an integral anti-disengagement abutment means comprising at least one of said strap web portions of said array on one of the strap sections having, behind the transverse face of one of said interlocking shoulders, an upwardly displaced corner defined by a secondary slit adjacent and parallel to said lateral jog region, said upwardly displaced corner forming a tongue arranged and positioned to oppose the transverse face of one of said non-interlocking shoulders in the overlapping length of metal strap so that upon shifting of the joined overlapping lengths of metal strap in a direction to disengage said interlocking engagement, said tongue and said opposing non-interlocking shoulder abut each other to provide a stop before disengagement occurs.

7. A strap segment capable of forming a sealless strap connection between overlapped lengths of strap which segment, at each terminal portion of said strap segment, comprises an array of longitudinally spaced joint elements with an integral anti-disengagement abutment means positioned on at least one of said joint elements formed in one of said strap lengths, each joint element comprising a lengthwise protuberance presenting an interlocking shoulder displaced from the plane of the strap segment and shaped to interlock with a superposed shoulder of the overlapped strap length and comprising a protuberance presenting a non-interlocking shoulder shaped to override a superposed interlocking shoulder of the overlapped strap length while said interlocking shoulder is moved into an interlocking position with said superposed interlocking shoulder of said overlapped strap length, and said abutment means comprises an upturned corner on a portion of at least one of said interlocking protuberances in said array on one of said strap lengths and is shaped to irreversibly override a superposed non-interlocking shoulder on the other of said strap lengths while interlocking shoulders of said arrays are moved into an interlocking position and said upturned corner presents a stop to the overridden superposed non-interlocking shoulder when said strap lengths interlock with each other.

8. A strap segment in accordance with claim 7, wherein said integral abutment means is formed on one of said joint elements which is at an end of said array of longitudinally spaced joint elements.

* * * * *